US005915330A

United States Patent [19]

Courville

[11] Patent Number: 5,915,330

[45] Date of Patent: Jun. 29, 1999

[54] APPARATUS FOR TEMPORARILY MARKING AUTOMOBILES AND METHOD OF USING SAME

[76] Inventor: John M. Courville, 5150 Red Bluff, #706, Pasadena, Tex. 77503

[21] Appl. No.: 08/851,398

[22] Filed: May 5, 1997

[51] Int. Cl.[6] ..... G09F 17/00

[52] U.S. Cl. ..... 116/209; 116/63 C; 116/28 R; 40/591

[58] Field of Search ..... 116/28 R, 173, 116/63 C, 209; 40/591, 592

[56] References Cited

U.S. PATENT DOCUMENTS

| | | | |
|---|---|---|---|
| 1,415,540 | 5/1922 | Fesser | 116/173 |
| 2,942,571 | 6/1960 | White | 116/63 C |
| 3,124,100 | 3/1964 | Morley | 116/173 |
| 3,451,368 | 6/1969 | Keats | 116/63 C |
| 3,590,506 | 7/1971 | Jeski | 116/28 R |
| 4,700,655 | 10/1987 | Kirby | 116/28 R |
| 4,967,410 | 10/1990 | Tomaiuolo | 116/173 |
| 5,363,792 | 11/1994 | Petechik | 116/28 R |
| 5,749,673 | 5/1998 | Kulp et al. | 116/63 C |

*Primary Examiner*—Diego Gutierrez
*Assistant Examiner*—Andrew Hirshfeld
*Attorney, Agent, or Firm*—Wendy K. Buskop; Bayko, Gibson et al

[57] ABSTRACT

A temporary automobile marker is provided with a hollow base cone and a tower cone attached to the top of the base cone. The tower cone is co-centric with the base cone but has a smaller diameter in order to form two surfaces that help reflect light in a discontinuous fashion in order to make the marker more visible. A magnet is encased within the hollow base cone. The bottom edge of the base cone is covered with a pad so that the base cone and the encased magnet will not harm the surface of the vehicle to which the marker is attached. A method for employing the marker is also provided.

19 Claims, 1 Drawing Sheet

APPARATUS FOR TEMPORARILY MARKING AUTOMOBILES AND METHOD OF USING SAME

BACKGROUND OF THE INVENTION

1. Field of the Invention

This invention relates to marking automobiles. In particular, the present invention relates to an apparatus and method of temporarily marking automobiles while they are being manufactured or delivered without damaging the vehicles themselves.

2. Description of the Related Art

During the heyday of the Ford Model T, all vehicles coming off the assembly line were identical. Identical color, identical features, identical price. The uniformity of the product line made it easy for the manufacturer to sort the finished product for shipping to the showroom floor. Now, however, many vehicles come with a variety of options and features. Computer automated manufacturing has enabled automobile manufacturers to cater to niche markets. These niche markets require certain combinations of the options and features available. Unfortunately, niche markets are usually not concentrated within one geographic area. Consequently, while the manufacturer may have sophisticated means for getting the right feature on the right car at the right time, the organizations that ship the car to the niche consumer lacks the manufacturer's sophistication.

There have been methods used in the past for marking automobiles. In some cases, the presence of an unusual feature is indicated by a decal or embossed plate that is permanently attached to the vehicle. However, not all features are so marked on the vehicle. Furthermore, aesthetic considerations discourage the permanent marking of vehicles in such a manner. Of course there is a written description of the options and features included with each vehicle. However, this is not much help to the shipper, who is under intense market pressure to deliver the product as quickly as possible. A need arose for marking automobiles to aid in the shipping and distribution process.

Initially, this need was met by a bowl that was placed on top of the vehicle. The cross-section of this bowl was triangular in shape with rounded corners. This prior art bowl was tapered such that the area of the triangular cross-section was greater at the base than at the top. Padded magnets were attached to the base of the bowl in order to attach the bowl to the (metal) roof or hood of the vehicle. While sufficient for indoor use, the flat sides of the prior art bowl induced a significant amount of drag force on the bowl. Furthermore, the thick magnet pads introduced a significant gap between the roof of the vehicle and the hollow interior of the bowl, allowing the wind to enter the hollow interior and increase the drag and lifting forces to the point where the bowl would separate (be blown off) from the vehicle when the car was moved aggressively during shipping.

There is therefore, a need in the art for a simple way to temporarily mark an automobile for shipping that does not separate from the vehicle when the latter is moved aggressively. It is an object of the present invention to solve the problems in the prior art.

SUMMARY OF THE INVENTION

A temporary automobile marker is provided with a hollow base cone and a tower cone attached to the top of the base cone. The tower cone is co-centric with the base cone but has a smaller diameter so that two distinct and approximately parallel surfaces are created that help reflect light in a discontinuous fashion and thus make the cone more visible. A magnet is encased within the hollow base cone. The bottom edge of the base cone is covered with a pad so that the base cone and the magnet will not harm the surface of the vehicle to which the marker is attached.

The method for employing the marker includes providing the marker itself, and placing the marker on a vehicle so that the magnet encased within the base cone attaches the marker to the vehicle. To remove the marker from the vehicle, an operator merely overcomes the magnetic force between the magnet and the vehicle.

DETAILED DESCRIPTION OF THE INVENTION

Figure 1:
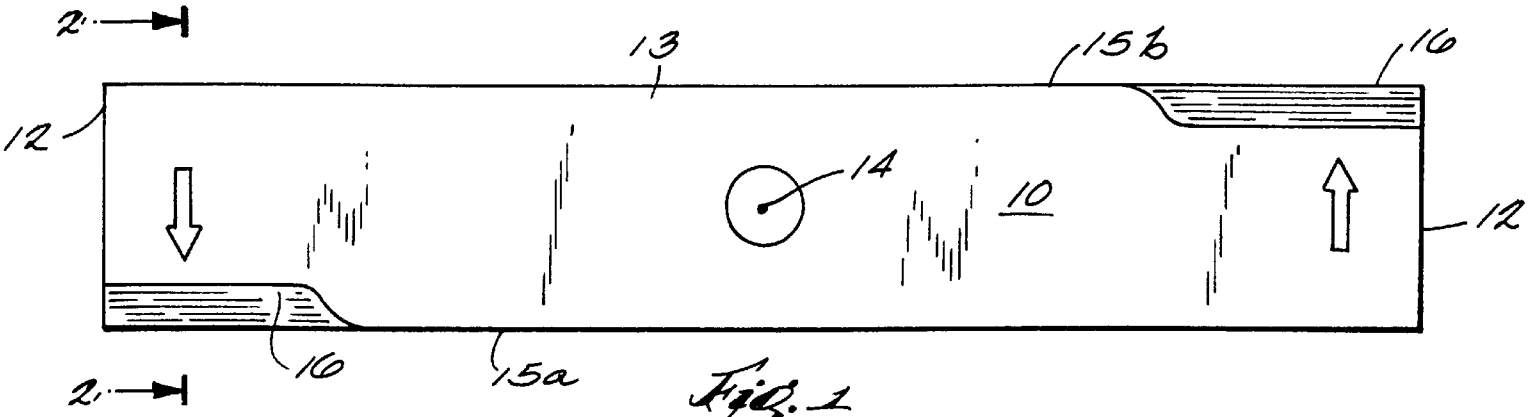
FIG. 1 shows an exploded view of the preferred embodiment of the present invention.
Figure 3:
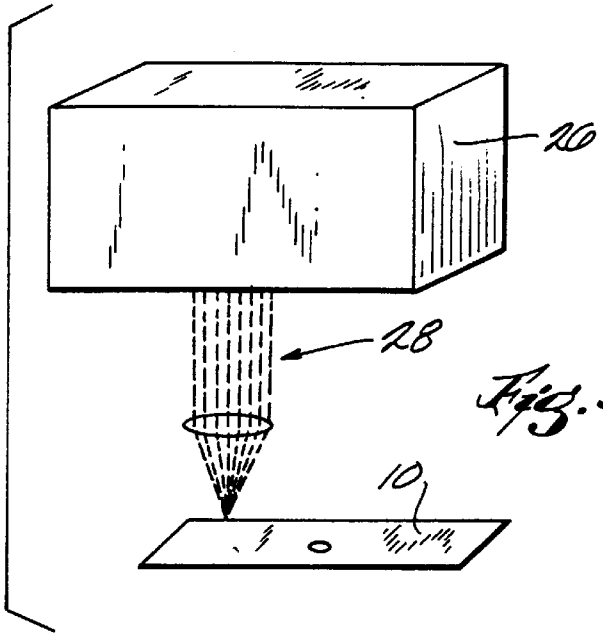
FIG. 3 shows an exploded view of still another embodiment of the invention.

The temporary automobile marker 10 of the present invention is shown, in exploded view, in FIG. 1. A hollow base cone 20 has a top edge 22 and a bottom edge 24. A tower cone 30 has a top edge 32 and a bottom edge 34. In the preferred embodiment of the present invention, the top edge 32 of the tower cone is enclosed with cap 36 as shown in FIG. 1. Both the base cone 20 and the tower cone 30 are circular conic sections, specifically truncated cones. In the preferred embodiment of the present invention, both the base cone 20 and the tower cone 30 are co-centric in that they share a common central axis. As shown in FIG. 1, bottom edge 34 of the tower cone 30 is situated adjacent to the top edge 22 of said base cone 20. In the preferred embodiment of the present invention, the tower cone 30 has a diameter less than that of the base cone 20 so that there is a diameter discontinuity in the form of an annular flange 29 where the base cone 20 and the tower cone 30 meet. This discontinuity makes two distinct (separate) surfaces 28 and 38 as shown in FIG. 1. Surfaces 28 and 38 can be parallel, although they do not have to be exactly parallel. In the preferred embodiment of the present invention as shown in FIG. 1, surfaces 28 and 38 are not exactly parallel, with surface 28 having a gentler taper than surface 38 (i.e., the surface 28 has a steeper taper angle and thus resembles a cylinder more than surface 38). In an alternate embodiment of the present invention (FIG. 3), the surface 38 has a steeper taper angle than the surface 28. In yet another embodiment of the present invention (FIG. 2), both surfaces 28 and 38 are parallel (i.e., they have identical taper angles). The discontinuity and only approximate parallel construction of the surfaces 28 and 38 enhances the visibility of the marker 10.

Figure 2:
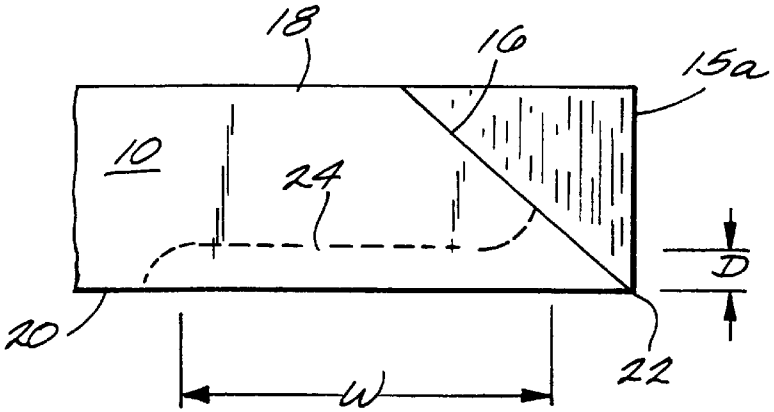
FIG. 2 shows an exploded view of an alternate embodiment of the present invention.

A magnet 40 is encased within the hollow volume of the base cone 20 in proximity to the bottom edge 24 of the base cone 20. The magnet is used to magnetically attach the marker to the vehicle. The magnet must be strong enough to overcome any drag and inertial forces that develop on the marker while the vehicle is being moved. In the preferred embodiment of the present invention, the magnet 40 is disk shaped as shown in FIG. 1. In an alternate embodiment of the present invention, the magnet 40 is ring shaped as shown in FIG. 2.

A pad 50 is attached to the bottom edge 24 of the base cone 20. In the preferred embodiment of the present invention, the pad 50 is disk shaped, as shown in FIG. 1. Pad 50 is used both to encase the magnet 40 within the hollow volume of the base cone 20 and to form a protective layer between the marker 10 and the vehicle to be marked. The protective layer provided by the pad 50 protects the vehicle from damage by the marker. In the preferred embodiment of the present invention, the pad 50 is made of felt. However, an alternate embodiment of the present invention can have a pad made from plastic or any other material that does not harm the surface of the vehicle. In an alternate embodiment of the present invention, the pad 50 is ring shaped, as shown in FIG. 2.

The magnet 40 may be retained within base cone 20 in a number of ways. First, the magnet may be press fit into base cone 20 assuming that the difference in size between the inside diameter of the base cone 20 and the outside diameter of the magnet 40 allows for a secure press fit. Alternatively, magnet 40 may be attached to the base cone 20 with glue. In yet another embodiment, a smaller magnet 40 may be retained within the base cone 20 by inserting the magnet 40 into the base cone 20 and then gluing pad 50 onto the base cone 20 so that the magnet 40 cannot fall out.

The base cone 20 and the tower cone 30 can be made as a single unit from plastic or metal. If the cones are made of plastic, they can be molded from an extrusion. In the preferred embodiment of the present invention, the plastic used to make the cones 20 and 30 are of a highly-visible fluorescent color, such as insignia orange, lime green, cherry red, or fuchsia. In an alternate embodiment of the present invention, the tower cone 30 is painted a different color from the base cone 20. The alternating colors further enhance the visibility of the marker 10.

The marker 10 is constructed by placing the magnet 40 within the hollow volume of the base cone 20. The magnet 40 is retained within the base cone 20 by gluing the pad 50 onto the bottom edge 24 of the base cone 20. Once this is complete, the marker 10 may be attached to any metal portion of a vehicle such that the magnetic force generated by the magnet 40 keeps the marker 10 attached to the vehicle. The circular conic cross-section of the cones 20 and 30 help reduce drag forces generated as the vehicle is moved, even if the vehicle is moved aggressively. Furthermore, the lack of a gap between the base cone 20 and the vehicle eliminates the drag and lift forces inherent in the prior art designs. Consequently the marker 10 of the present invention is better able to maintain contact on the vehicle during the shipping and distribution process. The marker 10 can be removed from the vehicle simply by physically overcoming the magnetic attraction generated by the magnet 40.

The foregoing is a description of the arrangement and the operation of an embodiment of the invention. The scope of the invention is considered to include the described embodiment together with others obvious to those skilled in the art.

What is claimed is:

1. A temporary vehicle marker consisting of:

a hollow base cone of frusto-conical configuration, said base cone having a top annular edge and a bottom annular edge, a tower cone of frusto-conical configuration having a bottom edge, said bottom edge of said tower cone situated adjacent to said top edge of said base cone, whereby the top edge of said base cone lies in a transverse radial plane with respect to said tower cone, said tower cone being co-centric and coaxial with, and of a lesser base diameter than the smallest transverse diameter of said base cone in order to make two separate conical exterior surfaces, to form a discontinuity in the form of an annular flange where the hollow base cone and the tower cone meet, and a magnet, said magnet encased within said hollow base cone in proximity to said bottom edge of said base cone, wherein said magnet causes said marker to become magnetically attached to a vehicle.

2. A marker as in claim 1 wherein said base cone and said tower cone are made of plastic.

3. A marker as in claim 1 wherein said base cone and said tower cone are made of metal.

4. A marker as in claim 1 wherein said base cone and said tower cone are covered with a fluorescent colored paint.

5. A marker as in claim 4 wherein said color for said base cone is different from said color for said tower cone.

6. A marker as in claim 1 wherein said tower cone has a top edge.

7. A marker as in claim 6 wherein said top edge of said tower cone is enclosed.

8. A marker as in claim 1 wherein said magnet is disk shaped.

9. A marker as in claim 1 wherein said magnet is ring shaped.

10. A marker as in claim 1 wherein said magnet is glued to said base cone.

11. A marker as in claim 1 wherein said magnet is press fit into said base cone.

12. A marker as in claim 1 wherein the taper angle of said tower cone is greater than the taper angle of said base cone.

13. A marker as in claim 1 wherein the taper angle of said tower cone is less than the taper angle of said base cone.

14. A marker as in claim 1 wherein the taper angle of said tower cone is equal to the taper angle of said base cone.

15. A temporary vehicle marker consisting of:

a hollow base cone of frusto-conical configuration, said base cone having a top annular edge and a bottom annular edge, a tower cone of frustro-conical configuration having a bottom edge, said bottom edge of said tower cone situated adjacent to said top edge of said base cone, whereby the top edge of said base cone lies in a transverse radial plane with respect to said tower cone, said tower cone being co-centric and coaxial with and of a lesser base diameter than the smallest transverse diameter of said base cone in order to make two separate conical exterior surfaces to form a discontinuity in the form of an annular flange where the hollow base cone and the tower cone meet and, a magnet, said magnet encased within said hollow base cone in proximity to said bottom edge of said base cone, wherein said magnet causes said marker to become magnetically attached to a vehicle, and a pad is attached to the bottom of said magnet in order to protect said vehicle from damage by said marker.

16. A marker as in claim 15 wherein said pad is made of felt.

17. A marker as in claim 15 wherein said pad is disk shaped.

18. A marker as in claim 15 wherein said pad is ring shaped.

19. A method for temporarily marking a vehicle consisting of the steps of:

providing a marker, said marker having a hollow base cone of frustro-conical configuration, said base cone with a top annular edge and a bottom annular edge, said marker further having a tower cone of frustro-conical configuration, situated adjacent to said top edge of said base cone, said tower cone being co-centric with, and of a lesser diameter than, said base cone in order to make two separate surfaces, and to form a discontinuity in the form of an annular flange, where the hollow base cone and the tower cone meet, and a magnet encased within said hollow base cone adjacent to said bottom edge of said base cone, and placing said magnet in said marker adjacent to a metal portion of a vehicle wherein said marker will become non-permanently attached to said vehicle and thus mark said vehicle.

* * * * *